US011565138B1

(12) United States Patent
Skinner et al.

(10) Patent No.: US 11,565,138 B1
(45) Date of Patent: Jan. 31, 2023

(54) SCENTED FILTER SYSTEM FOR A SANITARY FACE MASK

(71) Applicants: Brender Skinner, Deering, NH (US); Kim Taylor, Deering, NH (US)

(72) Inventors: Brender Skinner, Deering, NH (US); Kim Taylor, Deering, NH (US)

( * ) Notice: Subject to any disclaimer, the term of this patent is extended or adjusted under 35 U.S.C. 154(b) by 196 days.

(21) Appl. No.: 17/121,900

(22) Filed: Dec. 15, 2020

(51) Int. Cl.
*A62B 23/02* (2006.01)
*A41D 13/11* (2006.01)

(52) U.S. Cl.
CPC ..... *A62B 23/025* (2013.01); *A41D 13/113* (2013.01)

(58) Field of Classification Search
CPC .. A41D 13/11–1192; A62B 18/02–025; A62B 18/08; A62B 18/088; A62B 23/00–025; A62B 7/10
See application file for complete search history.

(56) References Cited

U.S. PATENT DOCUMENTS 7,311,105 B2 12/2007 Plummer, Jr.
9,629,401 B2 4/2017 Malki
D885,677 S 5/2020 Acosta
2009/0065006 A1* 3/2009 Patterson ..... A62B 18/025 128/205.27
2009/0145434 A1 6/2009 Hermann
2009/0260635 A1 10/2009 Dean
2012/0144556 A1 6/2012 Fiebel
2014/0053853 A1 2/2014 Hearst
2016/0129287 A1 5/2016 Danford
2018/0368492 A1* 12/2018 Qu ..... A41D 13/113
2019/0021993 A1* 1/2019 Green ..... A61M 16/0666
2021/0086005 A1* 3/2021 O'Brien ..... A62B 9/006
2021/0346732 A1* 11/2021 Tu ..... A62B 23/02

FOREIGN PATENT DOCUMENTS

WO 2016076952 5/2016

* cited by examiner

*Primary Examiner* — Rachel T Sippel
(74) *Attorney, Agent, or Firm* — Kyle A. Fletcher, Esq.

(57) ABSTRACT

The scented filter system for a sanitary face mask is a medical device. The scented filter system for a sanitary face mask is adapted for use with a patient. The scented filter system for a sanitary face mask filters the air that flows through the nose and mouth of a patient. The scented filter system for a sanitary face mask a diffusing structure into a mask. The diffusing structure attaches to the mask. The mask filters the bulk of the air that flows through the nose and mouth of a patient. The diffusing structure: a) filters the balance of the air that flows through the nose and mouth of a patient; and, b) releases a volatile phytochemical into the air that flows through the nose and mouth of a patient.

17 Claims, 7 Drawing Sheets

FIG. 7
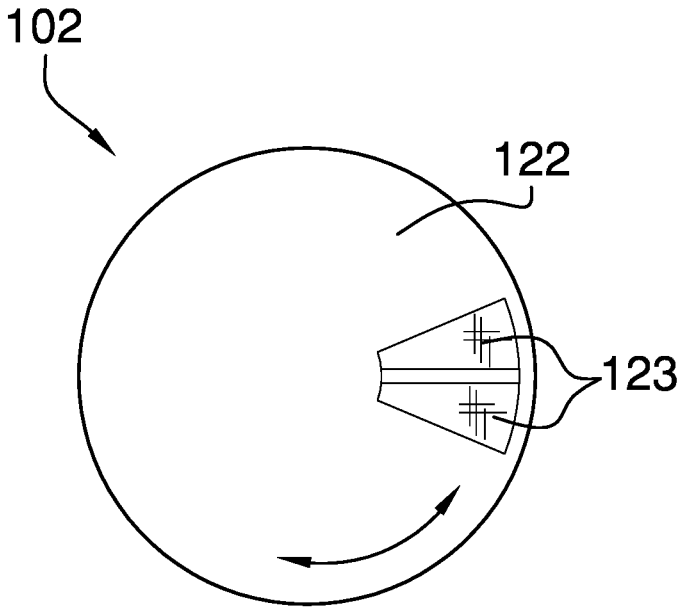
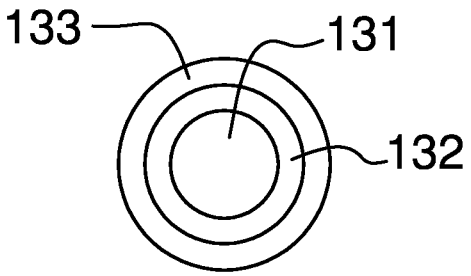
FIG. 8

SCENTED FILTER SYSTEM FOR A SANITARY FACE MASK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of protective face masks.

SUMMARY OF INVENTION

The scented filter system for a sanitary face mask is a medical device. The scented filter system for a sanitary face mask is adapted for use with a patient. The scented filter system for a sanitary face mask filters the air that flows through the nose and mouth of a patient. The scented filter system for a sanitary face mask comprises a mask and a diffusing structure. The diffusing structure attaches to the mask. The mask filters the bulk of the air that flows through the nose and mouth of a patient. The diffusing structure: a) filters the balance of the air that flows through the nose and mouth of a patient; and, b) releases a volatile phytochemical into the air that flows through the nose and mouth of a patient.

These together with additional objects, features and advantages of the scented filter system for a sanitary face mask will be readily apparent to those of ordinary skill in the art upon reading the following detailed description of the presently preferred, but nonetheless illustrative, embodiments when taken in conjunction with the accompanying drawings.

In this respect, before explaining the current embodiments of the scented filter system for a sanitary face mask in detail, it is to be understood that the scented filter system for a sanitary face mask is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the scented filter system for a sanitary face mask.

It is therefore important that the claims be regarded as including such equivalent construction insofar as they do not depart from the spirit and scope of the scented filter system for a sanitary face mask. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 7 is a detail view of an embodiment of the disclosure.

FIG. 8 is a detail view of an embodiment of the disclosure.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
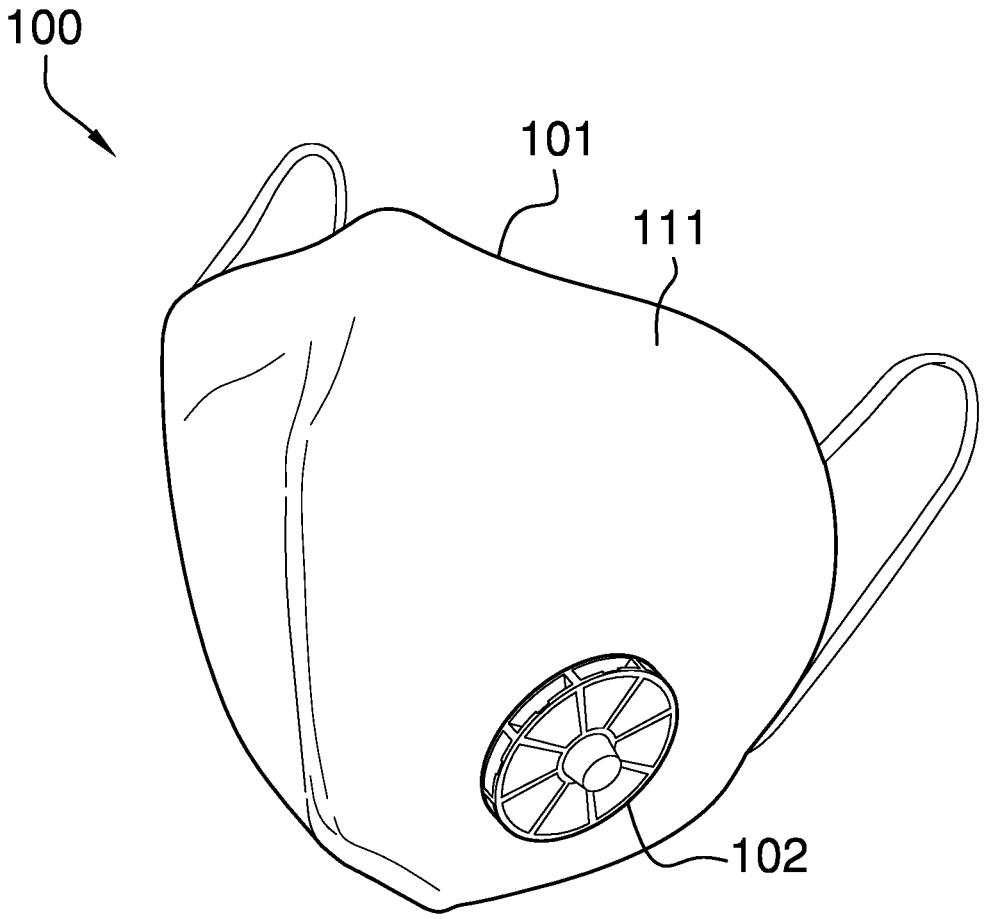
FIG. 1 is a perspective view of an embodiment of the disclosure.
Figure 2:
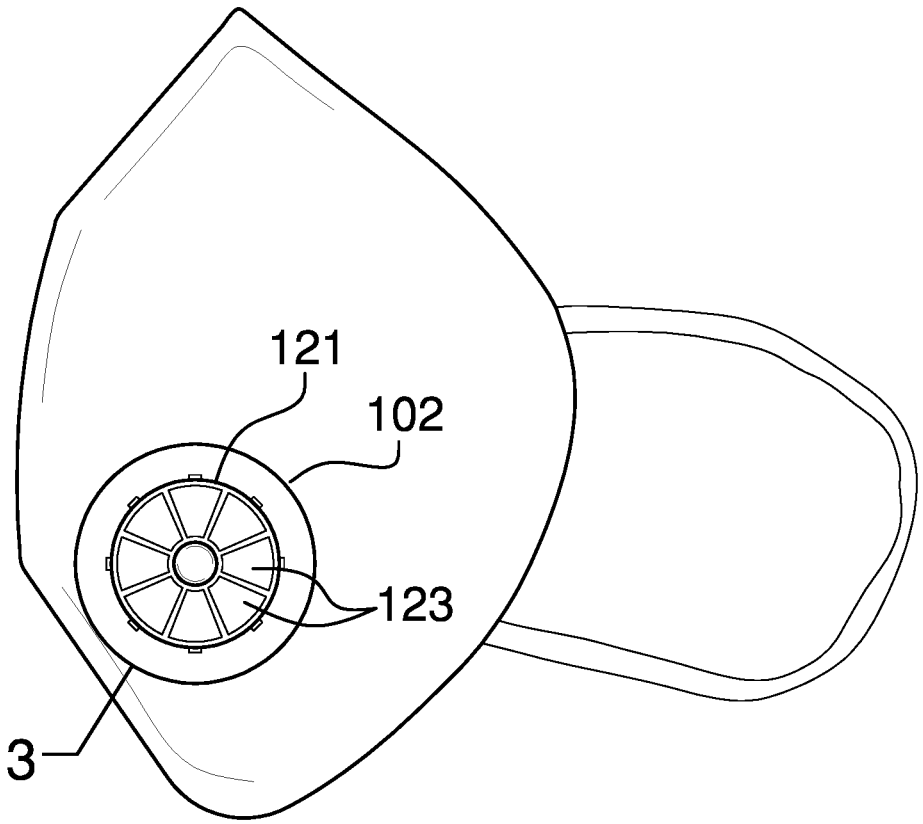
FIG. 2 is a front view of an embodiment of the disclosure.
Figure 3:
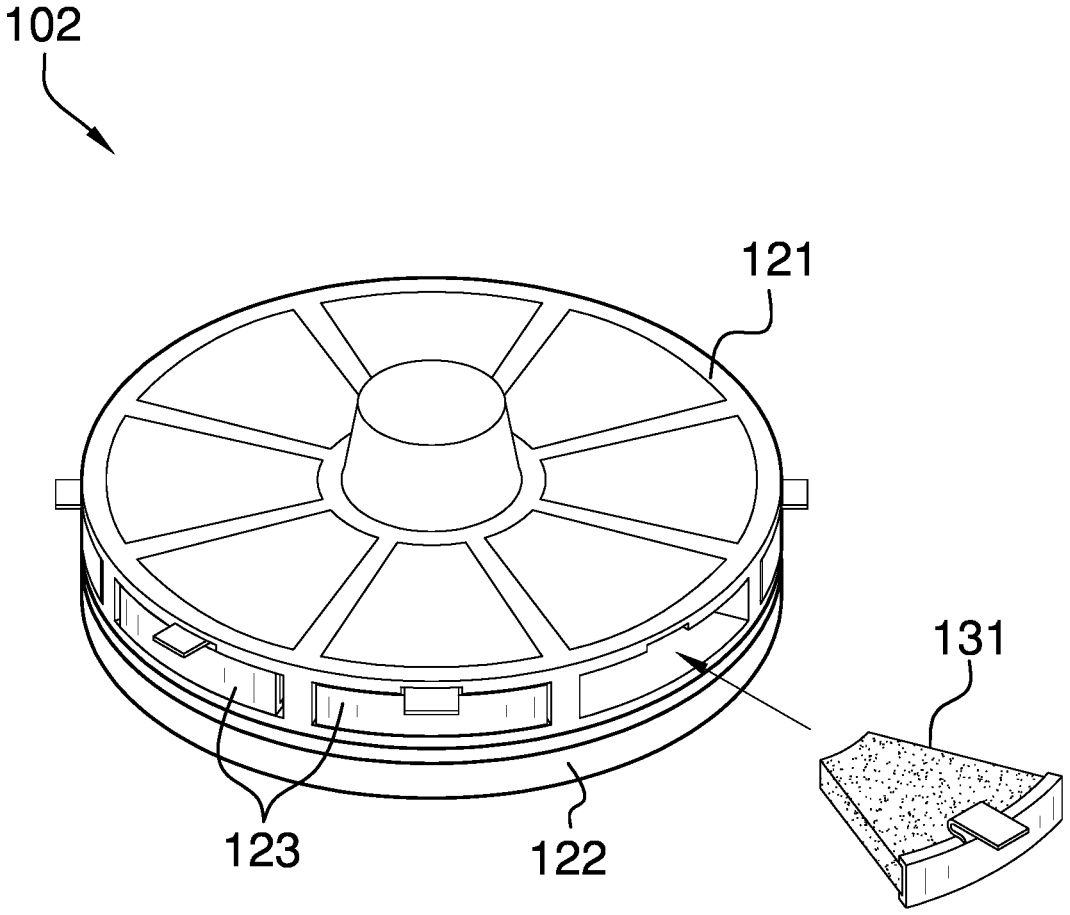
FIG. 3 is a perspective, close-up detail view of an embodiment of the disclosure along the encircled portion designated by the 3 in FIG. 2.
Figure 4:
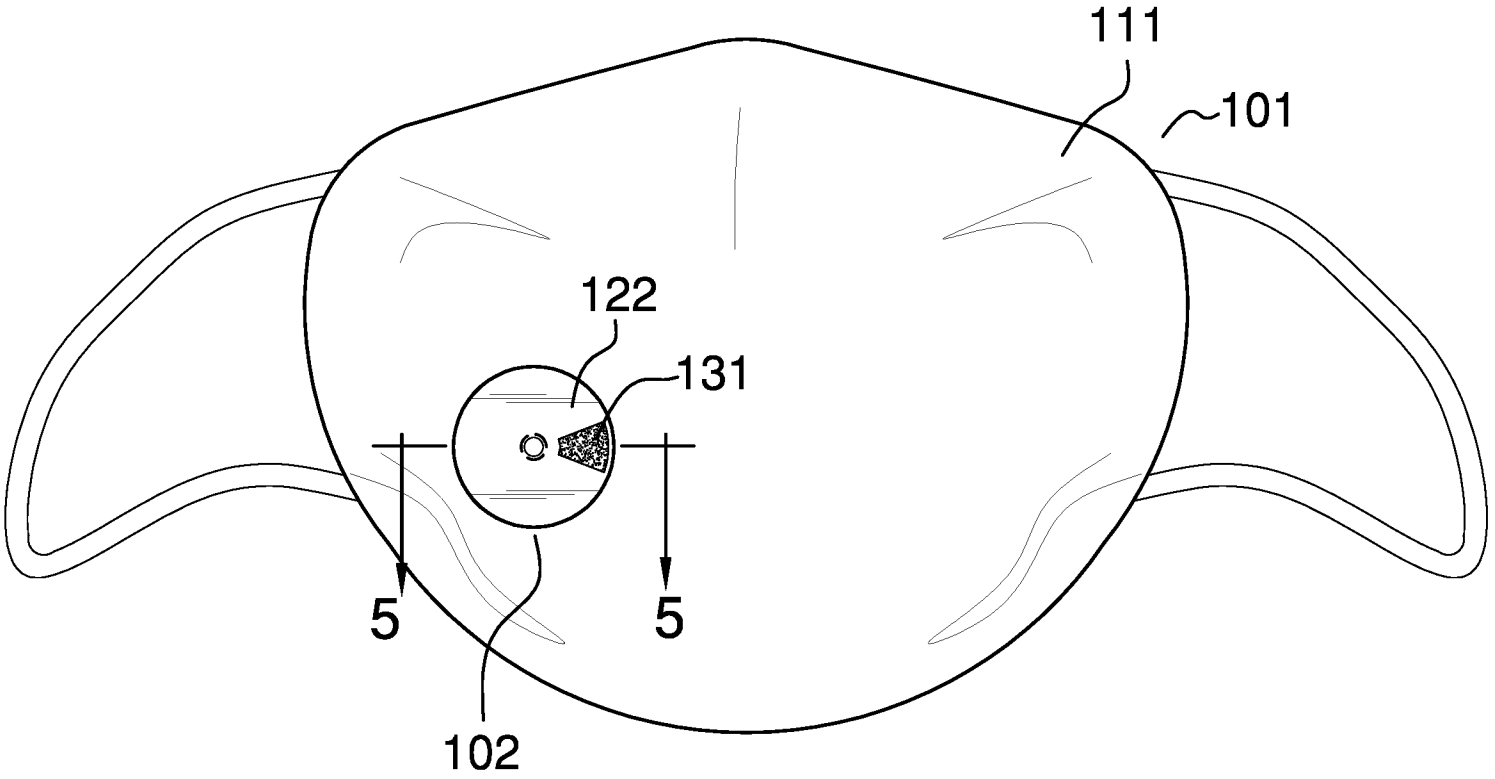
FIG. 4 is a rear view of an embodiment of the disclosure.
Figure 5:
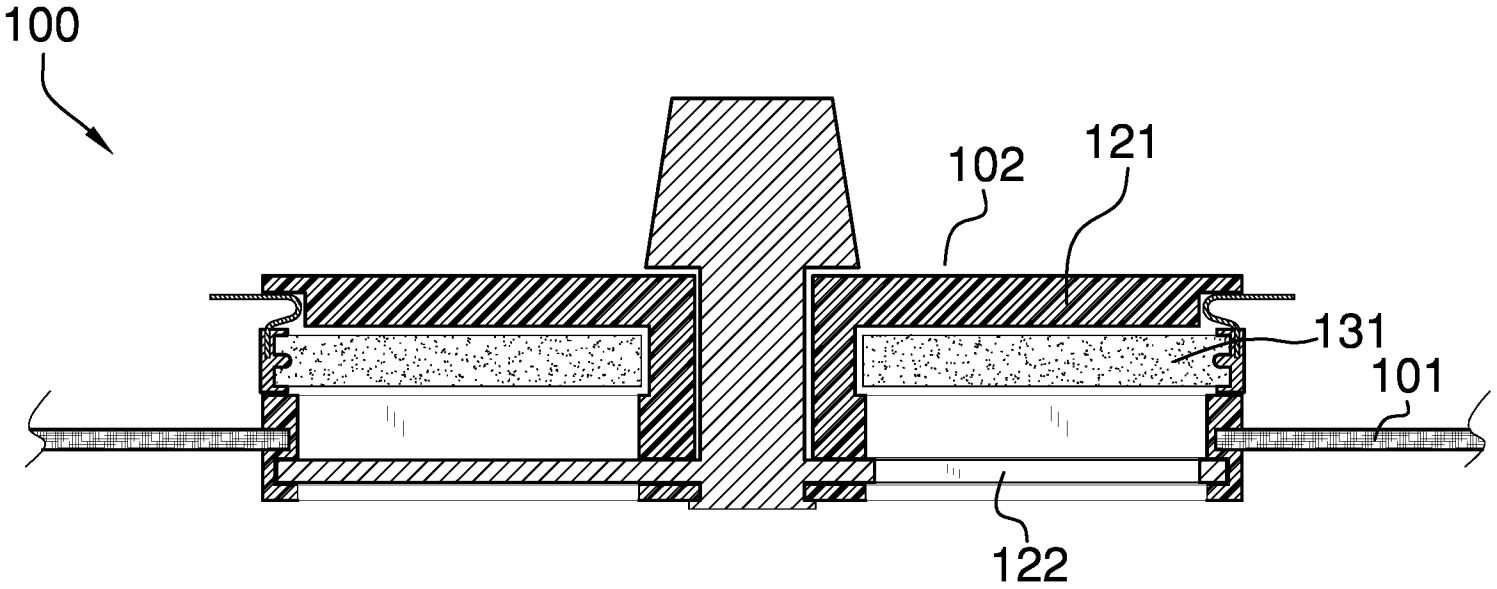
FIG. 5 is a cross-sectional view of an embodiment of the disclosure across 5-5 as shown in FIG. 4.
Figure 6:
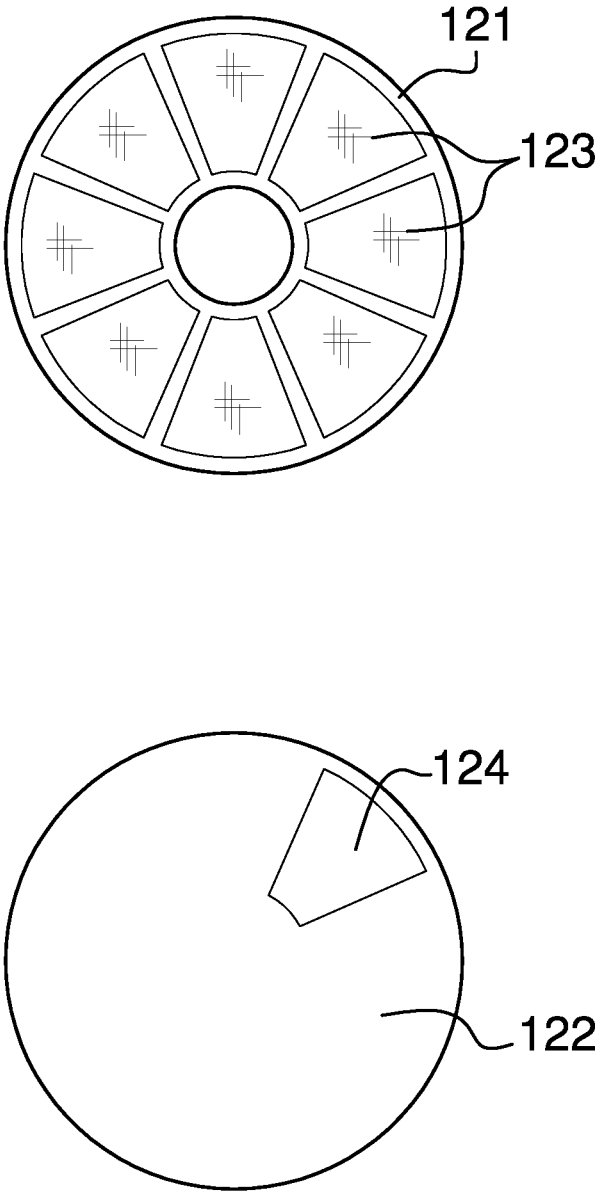
FIG. 6 is a detail view of an embodiment of the disclosure.

Detailed reference will now be made to one or more potential embodiments of the disclosure, which are illustrated in FIGS. 1 through 8.

The scented filter system for a sanitary face mask 100 (hereinafter invention) is a medical device. The invention 100 is adapted for use with a patient. The invention 100 filters the air that flows through the nose and mouth of a patient. The invention 100 comprises a mask 101 and a diffusing structure 102. The diffusing structure 102 attaches to the mask 101. The mask 101 filters the bulk of the air that flows through the nose and mouth of a patient. The diffusing structure 102: a) filters the balance of the air that flows through the nose and mouth of a patient; and, b) releases a volatile phytochemical into the air that flows into and through the nose and mouth of a patient.

The mask 101 is a face mask 101. The mask 101 is adapted for use with the patient. The mask 101 filters the bulk of the air that flows through the invention 100. The mask 101 is a surface filter that removes microorganisms from the air that flows through the mask 101. The mask 101 is worn over the nose and mouth of a patient. The mask 101 is defined elsewhere in this disclosure. The mask 101 further comprises a filter sheeting 111.

The filter sheeting 111 is a sheeting structure. The filter sheeting 111 is placed over the nose and mouth of the patient such that the air that flows through the filter sheeting 111 during the inhalation process is filtered. The filter sheeting 111 forms a surface filter that removes microorganisms from the air that flows through the filter sheeting 111.

The diffusing structure 102 is a mechanical structure. The diffusing structure 102 filters the balance of the air that flows through the invention 100. By filtering the balance of the air is meant that the diffusing structure 102 will filter any air the passes through the invention 100 but that is not filtered by the filter sheeting 111 of the mask 101. The diffusing structure 102 is a bed filter that removes microorganisms from the air that flows through the diffusing structure 102. The diffusing structure 102 mounts in the filter sheeting 111 of the mask 101. The diffusing structure 102 releases a volatile phytochemical substance into the air that flows through the diffusing structure 102. The phytochemical substance released by the diffusing structure 102 is a pharmacologically active media. In the first potential embodiment of the disclosure, the released phytochemical substance is intended to have a relaxing effect on a patient.

The diffusing structure 102 comprises a framework 121, a damper disk 122, and a plurality of diffusion disks 123. The damper disk 122 attaches to the framework 121. Each of the plurality of diffusion disks 123 insert into the framework 121.

The framework 121 is a mechanical structure. The framework 121 forms the framework 121 that contains the plurality of diffusion disks 123. The framework 121 is a disk-shaped structure. The framework 121 is an openwork structure. The openwork nature of the framework 121 allows the balance of the air that flows through the invention 100 to flow through the framework 121. The framework 121 contains the plurality of diffusion disks 123.

Each of the plurality of diffusion disks 123 inserts into the framework 121 through a lateral face of the disk structure of the framework 121. The air that flows through the diffusing structure 102 is routed through the framework 121. The framework 121 positions each of the plurality of diffusion disks 123 such that the balance of the air that flows through the invention 100 passes through one or more individual diffusion disks 131 selected from the plurality of diffusion disks 123.

The damper disk 122 is a disk-shaped structure. The damper disk 122 is geometrically similar to the congruent ends of the disk structure of the framework 121. The damper disk 122 attaches to the framework 121 such that the damper disk 122 partially encloses a congruent end of the disk structure of the framework 121. The damper disk 122 attaches to the framework 121 to form a composite prism structure. The damper disk 122 attaches to the framework 121 such that the damper disk 122 rotates relative to the framework 121. The axis of rotation of the damper disk 122 aligns with the center axis of the disk structure of the damper disk 122. The axis of rotation of the damper disk 122 aligns with the center axis of the disk structure of the framework 121.

The damper disk 122 is a selectable structure. The damper disk 122 controls the flow of air through the diffusing structure 102. By controlling the flow of air is meant that the damper disk 122 physically limits the amount of air that flows through the diffusing structure 102. By controlling the flow of air is meant that the damper disk 122 physically directs the air that flows through the diffusing structure 102 through one or more individual diffusion disks 131 selected from the plurality of diffusion disks 123.

The damper disk 122 further comprises an aperture 124. The aperture 124 is a negative space that is formed through both congruent ends of the damper disk 122. The aperture 124 forms a vent that allows air to flow into and out of the framework 121. The shape of the aperture 124 is geometrically similar to each individual diffusion disk 131 selected from the plurality of diffusion disks 123. The damper disk 122 rotates relative to the framework 121 in order to select the one or more individual diffusion disk 131 selected from the plurality of diffusion disks 123 through which the balance of the air that flows through the invention 100 flows.

Each of the plurality of diffusion disks 123 is a mechanical structure. Each of the plurality of diffusion disks 123 filters a portion of the balance of the air that flows through the invention 100. By filtering the balance of the air is meant that the plurality of diffusion disks 123 will filter any air the passes through the invention 100 but that is not filtered by the filter sheeting 111 of the mask 101. Each of the plurality of diffusion disks 123 is a bed filter that removes microorganisms from the air that flows through any individual diffusion disk 131. Each of the plurality of diffusion disks 123 inserts into the lateral face of the disk structure of the mask 101 of the framework 121.

Each of the plurality of diffusion disks 123 releases a volatile phytochemical substance into the air that flows through the diffusing structure 102. The phytochemical substance released by each of the plurality of diffusion disks 123 is a pharmacologically active media. Each of the plurality of diffusion disks 123 are identical with the potential exception of the phytochemical released by the individual diffusion disk 131.

The plurality of diffusion disks 123 comprises a collection of individual diffusion disks 131.

The individual diffusion disk 131 is a mechanical structure. The individual diffusion disk 131 filters a portion of the balance of the air that flows through the invention 100. The individual diffusion disk 131 forms a bed filter that filters the air that flows through each individual diffusion disk 131. The individual diffusion disk 131 releases a volatile phytochemical substance into air that flows through the individual diffusion disk 131. The phytochemical substance released by the individual diffusion disk 131 is a pharmacologically active media.

The individual diffusion disk 131 is a disk-shaped structure. The individual diffusion disk 131 has a non-Euclidean shape. The individual diffusion disk 131 has roughly the shape of a truncated triangle. The individual diffusion disk 131 has roughly the shape of a slice of pie. The shapes of the individual diffusion disks 131 are such that when each of the individual diffusion disks 131 insert into the framework 121, all the air flowing through the framework 121 is routed through an individual diffusion disk 131 selected from the plurality of diffusion disks 123.

Each individual diffusion disk 131 selected from the plurality of diffusion disks 123 is identical with the potential exception of the phytochemical released by the individual diffusion disk 131.

Each individual diffusion disk 131 further comprises an activated carbon substrate 132 and a fragrant coating 133.

An activated carbon substrate 132 forms the bed filter formed by the individual diffusion disk 131. Activated carbon is defined elsewhere in this disclosure. The air that flows through each individual diffusion disk 131 flows through the activated carbon substrate 132. The activated carbon substrate 132 forms a reactive surface area that adsorbs any microorganisms carried by air that flows through each individual diffusion disk 131. The activated carbon substrate 132 is contained within the individual diffusion disk 131 in a bulk solid format.

The fragrant coating 133 is a coating that is applied to the activated carbon substrate 132. The fragrant coating 133 is formed from the phytochemical that is released by the individual diffusion disk 131. The volatile nature of the phytochemical that forms the fragrant coating 133 allows the phytochemical to sublimate into the air flow as the air passes through the individual diffusion disk 131. The sublimation of the fragrant coating 133 releases the phytochemical into the air flow. In the first potential embodiment of the disclosure, the phytochemical used to form the fragrant coating 133 is an essential oil.

The following definitions were used in this disclosure:

Activated Carbon: As used in this disclosure, activated carbon is a form of carbon that is processed in a manner that presents a large surface area for chemical interactions. The surface of activated carbon is used to adsorb chemical contaminants from a fluid flow that is passed through the activated carbon.

Adsorption: As used in this disclosure, adsorption refers to the formation of a layer of molecules on a surface.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bed Filter: As used in this disclosure, a bed filter comprises a particulate material through which a fluid is passed such that particulate material captures solids contained within the fluid while allowing the fluid itself to pass through the particulate matter.

Bulk Solid: As used in this disclosure, a bulk solid is a material that is formed from an accumulation of discrete particles. While the discrete particles of the bulk solid are solid materials, in aggregate the physical performance of bulk solid will exhibit fluid characteristics such as flow or taking the shape of a container.

Cant: As used in this disclosure, a cant is an angular deviation from one or more reference lines (or planes) such as a vertical line (or plane) or a horizontal line (or plane).

Cartridge: As used in this disclosure, a cartridge is a device used to contain an object or material in a manner suitable for use by a mechanical device. A cartridge will removably insert into the mechanical device such that the mechanical device can use the object or material as part of the process performed by the mechanical device. The cartridge is removed from the mechanical device once the object or material has been consumed.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Chemical: As used in this disclosure, a chemical refers to a substance of a known or fixed composition. The term chemical is used to describe the substance when the details of the composition of the substance or properties of the substance are considered relevant to the disclosure at bar. The term properties is taken to mean both the measurable properties of the substance and the interactions of a first chemical with a second chemical. The term compound is considered a synonym for the term chemical. The term chemistry refers to the study and the use of the knowledge of the composition and properties of chemicals. The terms chemical reaction refers to the interactions between two or more chemical structures.

Coating: As used in this disclosure, a coating refers to a substance that is applied to the exterior surface of an object such that the coating forms a new exterior surface of the object. A coating is commonly said to be formed as a layer. Paint is an example of a common coating material.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Damper: As used in this disclosure, a damper is a device that: a) controls the volume of air flows into or through a structure; or, b) controls the routing and direction of the air that flows through a structure.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Essential Oil: As used in this disclosure, an essential oil is a lipid based solution that contains one or more volatile aroma compounds, dissolved in a non-polar solvent. The one or more volatile aroma compounds are often phytochemicals. Examples of naturally occurring essential oils include, but are not limited to, basil oil, black pepper oil, caraway oil, cannabis flower oil, cedar wood oil, cinnamon oil, citronella oil, chamomile oil, clove oil, davana oil, eucalyptus oil, frankincense oil, horseradish oil, jasmine oil, lavender oil, lemon oil, lemongrass oil, mandarin oil, nutmeg oil, orange oil, oregano oil, peppermint oil, pine oil, sage oil, sandalwood oil, star anise oil, and thyme oil. Basil oil, cedar wood oil, citronella oil, chamomile oil, clove oil, lavender oil, lemongrass oil, and peppermint oil are traditionally considered to have insect repellent and insecticide properties.

Extract: As used in this disclosure, an extract is a solution that contains one or more phytochemicals dissolved in a polar solvent including solvents such as ethanol and water.

Filter: As used in this disclosure, a filter is a mechanical device that is used to separate solids that are suspended in a liquid or a gas. A strainer is type of filter with what would be considered a coarse mesh measurement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Framework: As used in this disclosure, a framework refers to a second object or structure that encloses a first object or structure.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Lipid: As used in this disclosure, a lipid is an organic molecule that is soluble in nonpolar solvents.

Liquid: As used in this disclosure, a liquid refers to a state (phase) of matter that is fluid and that maintains, for a given pressure, a fixed volume that is independent of the volume of the container.

Mask: As used in this disclosure, a mask is a covering for the face of a person. A mask filters air as it passes through the nose and mouth of a patient.

Microorganism: As used in this disclosure, a microorganism is an organism too small to be viewed by the unaided eye. Microorganisms are typically single celled organisms such as bacteria, yeast, viruses, protozoa, fungi and algae. A pathogen refers to a microorganism that has the potential to cause illness or disease.

N95 Filter: As used in this disclosure, an N95 filter is a surface filter designed to remove particulates from an air flow. The established performance standard for the N95 filter requires that the N95 filter be capable of removing 95% of the particulates having a diameter of greater than or equal to 300 nanometers from the air flow. As a practical matter, most N95 filters remove over 99% (a published estimate that was current as this definition is written has 99.8%) of the particulates having a diameter of greater than or equal to 100 nanometers from the air flow. An N95 respirator, or less formally an N95 mask, is a respirator that filters the flow of breathing air through an N95 filter. An N99 filter is rated as removing over 99% of the particulates having a diameter of greater than or equal to 300 nanometers from the air flow.

Negative Space: As used in this disclosure, negative space is a method of defining an object through the use of open or empty space as the definition of the object itself, or, through the use of open or empty space to describe the boundaries of an object.

Non-Euclidean Structure: As used in this disclosure, a non-Euclidean structure is a structure wherein an axis of the structure lies on a non-Euclidean plane or is otherwise formed with a curvature.

Non-Polar Molecule: As used in this disclosure, a non-polar molecule refers to a molecular structure that: a) is electrically neutral; and, b) has a uniform spatial distribution of the electrons within the molecule.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Patient: As used in this disclosure, a patient is a person who is designated to receive a medical treatment, therapy or service. The term patient may be extended to an animal when used within the context of the animal receiving veterinary treatment or services.

Perimeter: As used in this disclosure, a perimeter is one or more curved or straight lines that bounds an enclosed area on a plane or surface. The perimeter of a circle is commonly referred to as a circumference.

Pharmacologically Active Media: As used in this disclosure, a pharmacologically active media refers to a chemical substance that has a biochemical or physiological effect on a biological organism.

Phase: As used in this disclosure, phase refers to the state of the form of matter. The common states of matter are solid, liquid, gas, and plasma.

Phytochemical: As used in this disclosure, a phytochemical is a pharmacologically active media that is produced in and harvested from a plant.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it.

Polar Molecule: As used in this disclosure, a polar molecule refers to a molecular structure that: a) is electrically neutral; but, b) does not have a uniform spatial distribution of the electrons within the molecule. A polar molecule will present one or more electrically positive poles and the same number of electrically negative poles within the molecular structure.

Polarity: As used in this disclosure, the term polarity is used to describe a physical property or physical characteristic wherein: 1) the physical property or physical characteristic manifests two opposing attributes, tendencies, characteristics, or principals; and, 2) the two opposing attributes, tendencies, characteristics, or principals have an intrinsic separation, alignment, or orientation.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Roughly: As used in this disclosure, roughly refers to a comparison between two objects. Roughly means that the difference between one or more parameters of the two compared objects are not significantly different.

Rounded: A used in this disclosure, the term rounded refers to the replacement of an apex, vertex, or edge or brink of a structure with a (generally smooth) curvature wherein the concave portion of the curvature faces the interior or center of the structure.

Solid: As used in this disclosure, a solid refers to a state (phase) of matter that: 1) has a fixed volume; and, 2) does not flow.

Solution: As used in this disclosure, a solution is a uniform mixture of two or more compounds in a liquid phase. The major component selected from the two or more compounds that forms the solution is called the solvent. The components remaining in the two or more compounds are called the solute. A polar solvent is a solvent formed from polar molecules. A non-polar solvent is a solvent formed from non-polar molecules. The rule of thumb that "like dissolves like" states that: a) solutes formed from polar molecules will dissolve in polar solvents but will not dissolve in non-polar solvents; and, b) solutes formed from non-polar molecules will dissolve in non-polar solvents but will not dissolve in polar solvents.

Sublimation: As used in this disclosure, sublimation refers to a phase transition directly from a solid phase to a gas phase in a manner that bypasses the liquid phase.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

Triangle: As used in this disclosure, a triangle is an enclosed geometric shape with a perimeter that is formed by three intersecting edges that form three vertices. The triangle is considered a polygon. If the measure of the interior angle with the largest arc formed by the triangle is greater than 90 degrees, then the triangle is called an obtuse triangle. If the measure of the interior angle with the largest arc formed by the triangle equals 90 degrees, then the triangle is called a right triangle. The longest edge of the triangle is called the hypotenuse. The remaining two edges are called the legs of the triangle. If the measure of the interior angle with the largest arc formed by the triangle is lesser than 90 degrees, then the triangle is called an acute triangle. An equilateral triangle has three edges of equal length. An isosceles triangle has two edges (the legs) of equal length. A scalene triangle has edges of three different lengths.

Truncated: As used in this disclosure, a geometric object is truncated when an apex, vertex, or end is cut off by a line or plane.

Vertex: As used in this disclosure, a vertex (plural vertices) is an angle that is formed by two lines (or a plurality of surfaces) that form a point. Vertices are commonly found in polygons, prisms and pyramids.

Volatile: As used in this disclosure, volatile refers to a substance that will evaporate or sublimate into a gas state at normal temperature and pressure.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A scented filter system for a personal protection device comprising a mask and a diffusing structure;

wherein the diffusing structure attaches to the mask;

wherein the scented filter system for the personal protection device is a medical device;

wherein the scented filter system for the personal protection device filters air that flows through the scented filter system for the personal protection device;

wherein the mask filters the bulk of the air that flows through the scented filter system for the personal protection device;

wherein the diffusing structure: a) filters the balance of the air that flows through the scented filter system for the personal protection device; and, b) releases a volatile phytochemical into the air that flows through the diffusing structure;

wherein the diffusing structure comprises a framework, a damper disk, and a plurality of diffusion disks;

wherein the damper disk attaches to the framework;

wherein each of the plurality of diffusion disks inserts into the framework through a lateral face of a disk structure of the framework;

wherein the air that flows through the diffusing structure is routed through the framework.

2. The scented filter system for the personal protection device according to claim 1 wherein the mask is a face mask;

wherein the mask is a surface filter that removes microorganisms from the air that flows through the mask.

3. The scented filter system for the personal protection device according to claim 2 wherein the mask further comprises a filter sheeting;

wherein the filter sheeting is a sheeting structure;

wherein the air that flows through the filter sheeting is filtered;

wherein the filter sheeting forms a surface filter that removes microorganisms from the air that flows through the filter sheeting.

4. The scented filter system for the personal protection device according to claim 3 wherein the diffusing structure is a mechanical structure;

wherein by filtering the balance of the air is meant that the diffusing structure will filter any air the passes through the scented filter system for the personal protection device but that is not filtered by the filter sheeting of the mask.

5. The scented filter system for the personal protection device according to claim 4 wherein the diffusing structure is a bed filter that removes microorganisms from the air that flows through the diffusing structure.

6. The scented filter system for the personal protection device according to claim 5 wherein the diffusing structure mounts in the filter sheeting of the mask.

7. The scented filter system for the personal protection device according to claim 6 wherein the diffusing structure releases a volatile phytochemical substance into the air that flows through the diffusing structure;

wherein the phytochemical substance released by the diffusing structure is a pharmacologically active media.

8. The scented filter system for the personal protection device according to claim 7 wherein the framework is a mechanical structure;

wherein the framework forms the framework that contains the plurality of diffusion disks;

wherein the framework is a disk-shaped structure;

wherein the framework is an openwork structure;

wherein the openwork nature of the framework allows the balance of the air that flows through the scented filter system for the personal protection device to flow through the framework.

9. The scented filter system for the personal protection device according to claim 8 wherein the framework positions each of the plurality of diffusion disks such that the balance of the air that flows through the scented filter system for the personal protection device passes through one or more individual diffusion disks selected from the plurality of diffusion disks.

10. The scented filter system for the personal protection device according to claim 9 wherein the damper disk is a disk-shaped structure;

wherein the damper disk is geometrically similar to the congruent ends of the disk structure of the framework;

wherein the damper disk attaches to the framework such that the damper disk partially encloses a congruent end of the disk structure of the framework.

11. The scented filter system for the personal protection device according to claim 10 wherein the damper disk attaches to the framework to form a composite structure;

wherein the damper disk attaches to the framework such that the damper disk rotates relative to the framework;

wherein the axis of rotation of the damper disk aligns with the center axis of the disk structure of the damper disk;

wherein the axis of rotation of the damper disk aligns with the center axis of the disk structure of the framework.

12. The scented filter system for the personal protection device according to claim 11 wherein the damper disk is a selectable structure;

wherein the damper disk controls the flow of air through the diffusing structure;

wherein by controlling the flow of air is meant that the damper disk physically limits the amount of air that flows through the diffusing structure;

wherein by controlling the flow of air is meant that the damper disk physically directs the air that flows through the diffusing structure through one or more individual diffusion disks selected from the plurality of diffusion disks.

13. The scented filter system for the personal protection device according to claim 12 wherein the damper disk further comprises an aperture;

wherein the aperture is a negative space that is formed through both congruent ends of the damper disk;

wherein the aperture forms a vent that allows air to flow into and out of the framework;

wherein the shape of the aperture is geometrically similar to each individual diffusion disk selected from the plurality of diffusion disks;

wherein the damper disk rotates relative to the framework in order to select the one or more individual diffusion disk selected from the plurality of diffusion disks through which the balance of the air that flows through the scented filter system for the personal protection device flows.

14. The scented filter system for the personal protection device according to claim 13 wherein each of the plurality of diffusion disks is a mechanical structure;

wherein each of the plurality of diffusion disks filters a portion of the balance of the air that flows through the scented filter system for the personal protection device;

wherein each of the plurality of diffusion disks is a bed filter that removes microorganisms from the air that flows through any individual diffusion disk;

wherein each of the plurality of diffusion disks inserts into the lateral face of the disk structure of the mask of the framework;

wherein each of the plurality of diffusion disks releases the volatile phytochemical substance into the air that flows through the diffusing structure.

15. The scented filter system for the personal protection device according to claim 14 wherein the plurality of diffusion disks comprises a collection of individual diffusion disks;

wherein each individual diffusion disk is a mechanical structure;

wherein each individual diffusion disk filters a portion of the balance of the air that flows through the scented filter system for the personal protection device;

wherein each individual diffusion disk forms a bed filter that filters the air that flows through each individual diffusion disk;

wherein each individual diffusion disk releases the volatile phytochemical substance into air that flows through each individual diffusion disk.

16. The scented filter system for the personal protection device according to claim 15 wherein each individual diffusion disk is a disk-shaped structure;

wherein each individual diffusion disk has a non-Euclidean shape;

wherein the shapes of the individual diffusion disks are such that when each of the individual diffusion disks insert into the framework, all the air flowing through the framework is routed through an individual diffusion disk selected from the plurality of diffusion disks.

17. The scented filter system for the personal protection device according to claim 16 wherein each individual diffusion disk further comprises an activated carbon substrate and a fragrant coating;

wherein an activated carbon substrate forms the bed filter formed by each individual diffusion disk;

wherein the air that flows through each individual diffusion disk flows through the activated carbon substrate;

wherein the activated carbon substrate forms a reactive surface area that adsorbs any microorganisms carried by air that flows through each individual diffusion disk;

wherein the activated carbon substrate is contained within each individual diffusion disk in a bulk solid format;

wherein the fragrant coating is a coating that is applied to the activated carbon substrate;

wherein the fragrant coating is formed from the phytochemical that is released by each individual diffusion disk;

wherein the volatile nature of the phytochemical that forms the fragrant coating allows the phytochemical to sublimate into the air flow as the air passes through each individual diffusion disk;

wherein the sublimation of the fragrant coating releases the phytochemical into the air flow.

* * * * *